United States Patent [19]

Ogawa

[11] 3,968,598

[45] July 13, 1976

[54] WORKPIECE LAPPING DEVICE

[75] Inventor: Haruo Ogawa, Chichibu, Japan

[73] Assignees: Canon Kabushiki Kaisha, Tokyo; Canon Denshi Kabushiki Kaisha, Saitama, both of Japan

[22] Filed: Sept. 30, 1974

[21] Appl. No.: 510,781

Related U.S. Application Data

[63] Continuation of Ser. No. 324,781, Jan. 18, 1974, abandoned.

[30] Foreign Application Priority Data

Jan. 20, 1972 Japan ..... 47-7771

[52] U.S. Cl. ..... 51/55; 51/131

[51] Int. Cl.[2] ..... B24B 7/04; B24B 7/16

[58] Field of Search ..... 51/55, 56, 123 R, 124 R, 51/124 L, 126, 131, 132, 133, 134, 281 SF

[56] References Cited

UNITED STATES PATENTS

| | | | |
|---|---|---|---|
| 1,577,137 | 3/1926 | Maynard | 51/133 |
| 2,195,065 | 3/1940 | Wallace | 51/56 X |
| 2,274,332 | 2/1942 | Jarrett | 51/131 |
| 2,284,056 | 5/1942 | Inoge | 51/55 |
| 2,415,646 | 2/1947 | Luboshez | 51/131 |
| 3,564,776 | 2/1971 | Aspden | 51/55 |
| 3,566,544 | 3/1971 | Aspden | 51/55 |

*Primary Examiner*—Al Lawrence Smith
*Assistant Examiner*—Nicholas P. Godici
*Attorney, Agent, or Firm*—Fitzpatrick, Cella, Harper & Scinto

[57] ABSTRACT

The grain processing machine of this invention includes a supporting member for supporting work to be processed, a first rotation drifting motor including a rotating shaft for rotating the supporting member in one direction, a rotating member for grain processing disposed opposite to the work to be processed, and a rotating shaft for the rotating member. The rotating shaft of the rotating member is offset from the rotating shaft of the supporting member. A second driving motor is provided for rotating the rotating member in the same directon as the supporting member in a way in which the path that an arbitrary point on the work makes on the rotating member is helical and the difference in the number of revolutions between the rotating member and the work to be processed is not more than 30% but more than 0%, and apparatus is provided for shifting the rotating shaft of the rotating member. The rotating member is rotated in the same direction as the holding means in a way in which a sliding locus of an arbitrary point of said work to be processed by the rotating member is helical and the difference in the number of rotations between the rotating member and the work to be processed is 30% or less.

5 Claims, 13 Drawing Figures

WORKPIECE LAPPING DEVICE

This is a continuation of application Ser. No. 324,781, filed Jan. 18, 1974, for GRAIN PROCESSOR, now abandoned.

BACKGROUND OF THE INVENTION

1. Field of the Invention

This invention relates to grain processors such as lapping machines, surface grinders, superfinishing machines and the like in which grain is slid into contact with work at an almost constant relative velocity.

2. Description of the Prior Art

Lapping is a process for smoothly finishing the surface of work in a manner whereby a mixture of suitable free grain (which is also called lapping material using alundum grain and carborundum grain as grinding grain of fine grain size and chrome oxide or iron oxide or the like) and oil or the like is placed between a tool and a surface to be finished of the work, and said work is pressed against the tool at a suitable pressure, or a grinding abrasive wheel as a tool is caused to be rotated to slide and contact with the work so as to effect the relative movement between the tool and the work, whereby a very small amount of shavings or chips are ground off from the surface of the work by the grain.

Also a method has been utilized, which employs an abrasive wheel exactly similar to that employed for lapping as described above, in which the work is pressed against the tool with grain fixed at a suitable pressure and said tool and the work are driven so as to effect relative movement so that the surface may be smoothly finished by grinding off a very small amount of chips from the surface of the work by the grain. In describing the present invention the processor with the provision of free grain as seen in the lapping described above and the other processor with the provision of fixed grain as seen in the abrasive wheel are generally called grain processors.

By use of such grain processors, the cutting and the polishing may be accomplished on the outer surface and the plane of the cylindrical shaped work. Such grain processors are further roughly divided, as follows.

That is, the following are methods conventionally employed, which include, with the rotation of an abrasive wheel, A. that the work is pressed against the said abrasive wheel in a fixed position, B. that the work is carried by holding means, said work being brought into contact with the abrasive wheel to cause the work to also rotate by utilization of the speed difference in a radial direction of the abrasive wheel, and C. that the work is mounted on the holding means to cause it to rotate in a direction opposite to that of said abrasive wheel.

Here, the classification is based on the method of using the abrasive wheel, but another classification may also be made in quite a similar manner thereto by using the lapping.

On the other hand, it is known that the amount of cutting and polishing of the work by the abrasive wheel depends upon a function of the relative velocity and the slide-and-contact distance (total extended distance in which the work is slid into contact with the abrasive wheel within the total processing time) between the work and the abrasive wheel.

However, in either case of the foregoing respective methods by use of the grain processors heretofore used, satisfactory results were impossible to obtain with respect to uniform slide-contact with the surface of the work. That is, according to method (A), in which the work is pressed against the abrasive wheel, among the respective portions where the work is slid into contact with the abrasive wheel, the portion adjacent to the center of rotation of the abrasive wheel has a radius of rotation smaller than that of the remote portion so that its relative velocity and slide-and-contact distance are also smaller, resulting in reducing the amount of slide-and-contact as compared to the remote portion from the center of rotation. Thus, it is impossible to perform uniform polishing and cutting. Further, according to the method ad described in the aforesaid (B), it may be said, in the sense of probability, to have almost the same slide-and-contact distance in the respective slide-and-contact portions between the work and the abrasive wheel, but it cannot be positively said that the same slide-and-contact distance is obtained because the holding means to hold the work is not forcibly driven, as previously mentioned. Further, according to the method utilizing a relative velocity as described in (C) above, the portion adjacent the center of rotation of the holding means has a difference between the maximum and minimum relative velocity with respect to the abrasive wheel which is smaller than the portion adjacent the outer periphery, and thus the respective portions of the work are naturally unequally treated. Further, in the case when the work is mounted and is caused to be forcibly rotated, it is common to have a different form of slide-and-contact between the adjacent portion and the portion remote from the center of rotation of the holding means.

SUMMARY OF THE INVENTION

With the foregoing considerations in mind, the primary object of the present invention is to provide a grain processor wherein the slide-and-contact distance between the work and the grain is made to be almost constant in respective portions of the work, whereby the respective portions of the work are uniformly cut or polished.

Another object of this invention is to provide a grain processor wherein the slide-and-contact direction, with respect to the grain at a suitable point on the work, is so made as to be uniformly distributed towards respective directions, whereby the respective portions of the work are uniformly cut or polished.

A further object of the invention is to provide a grain processor which is able to uniformly cut and polish the respective portions of the work at a high speed.

A further object of the invention is to provide a grain processor wherein the work holding means is forcibly rotated in the same direction as the rotating member (abrasive wheel or lapping base or the like) and the number of revolutions of the holding means is almost the same as that of the rotating member.

A further object of the invention is to provide a grain processor wherein the work holding means is forcibly rotated in the same direction as that of the rotating member with almost the same number of revolutions, and the holding means and the rotating member are made to be relatively rockable so that the respective portions of the work may be cut and polished uniformly and at a high speed.

DESCRIPTION OF THE PREFERRED EMBODIMENTS

FIGS. 1 to 4 show the relative motion between the abrasive wheel and the work holding means, during the operation of cutting, as applied to one mode of embodiment of the grain processing machine according to the present invention, and with reference to these drawings the principle of the cutting operation of the grain processing machine according to the present invention will now be described.

Figure 1:
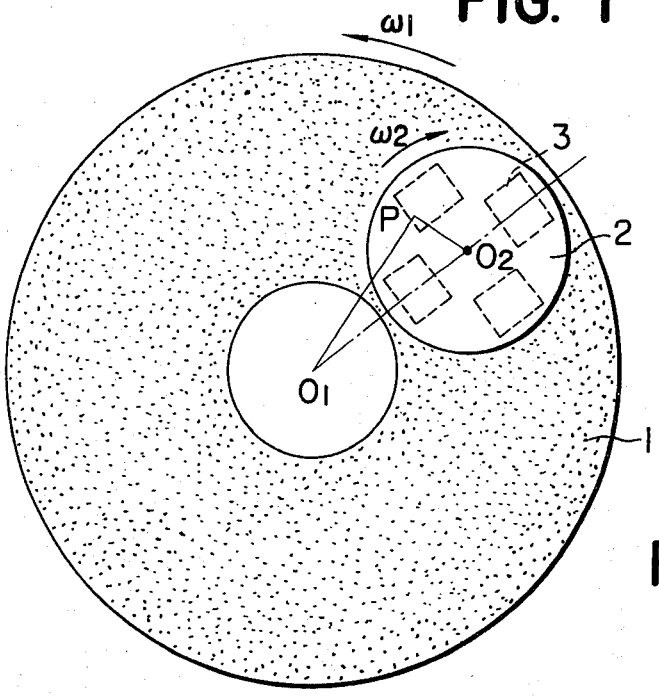
FIG. 1 is a plan view for analyzing the rotational motion between the abrasive wheel and the work holding means in a general grain processing machine.

In FIG. 1, the abrasive wheel is designated at 1, which is rotated by the hereinafter described driving mechanism on its point $O_1$. The holding means which rotates the holding work is designated at 2, which is rotatably positioned on its point $O_2$ opposite to said abrasive wheel. The work is designated at 3, which is mounted on said holding means and is rotated integral with said holding means. Since FIG. 1 is a plan view, as viewed from the top of the holding means, the elements are vertically arranged in the following order: the abrasive wheel 1, the work 3, and the holding means 2, the contour of the work being designated by the broken line. In an actual machine, the work 3 is mechanically mounted or attached thereto using adhesives and the like on the face of the holding means 2 opposite to the abrasive wheel 1, and said holding means is constructed so as to be pressed towards the abrasive wheel by means of pressure caused by a spring or the like so that the surface to be worked of the work 3 is brought into contact with the wheel surface. In FIG. 1, P represents a suitable point within the surface to be worked. Both centers $O_1$ and $O_2$ of rotation are points in a fixed condition. Now it is assumed that in FIG. 1 the abrasive wheel 1 rotates on its $O_1$ in a counterclockwise direction at an angular velocity $\omega_1$, while the holding means rotates on its $O_2$ in a clockwise direction, reverse to the abrasive wheel, at an angular velocity $\omega_2$ in the same FIGURE. In order to obtain the relative velocity caused by the relative motion between the abrasive wheel and the work at a suitable point P of the work at that time, a vector diagram is provided as shown in FIG 2 representing both motions.

In the same figure, polar coordinates with $O_1$ of the point P as an origin are designated $(\gamma, \theta)$. In a sense of dynamics, when a point P moves depicting an orbit within the space (in the plane in this case), the position of P is expressed by vector $\gamma$ drawn from the origin $O_1$, which is called a position vector, and this $\gamma$ is differentiated by time to obtain a velocity vector (or velocity) $Vo_1$ at point P. The magnitude of the velocity vector $Vo_1$, namely the velocity $Vo_1$ is known to be equal to $\gamma\omega_1$ when P rotates on its $O_1$, and its direction is tangent with the orbit.

Figure 2:
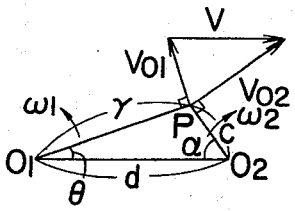
FIG. 2 is a diagram showing a velocity vector at one suitable point P of the work in order to analyze the rotational motion shown in FIG. 1.

Velocity vectors $Vo_1$ and $Vo_2$, with distance $\overline{O_1O_2}$ between the axes of the abrasive wheel and the holding means made at $d$, of both rotational motions at the point P are depicted as shown in FIG. 2. Accordingly, the velocity vector of the relative motion caused by those motions as described is shown at V. If the distance between $O_2$ and point P is C and the direction of rotational circular motion in a clockwise direction is positive, the velocities for both velocity vectors $Vo_1$ and $Vo_2$ are respectively expressed by $$Vo_1 = \gamma\omega_1,\ Vo_2 = -C\omega_2 \tag{1}$$

If an angle of $\overline{O_2O_1}$ to $\overline{O_2P}$ is made $\alpha$, it follows that $$\left.\begin{aligned} C^2 &= r^2 + d^2 - 2\,rd\cos\theta \\ r^2 &= c^2 + d^2 - 2\,Cd\cos\alpha \\ d^2 &= r^2\,C^2 + 2\,rC\cos(\theta+\alpha) \end{aligned}\right\} \tag{2}$$

$$\frac{r}{\sin\alpha} = \frac{C}{\sin\theta} = \frac{d}{\sin(\theta+\alpha)} \tag{3}$$

Thereby, the magnitude of the relative velocity vector V shown in FIG. 2 is given by $$V^2 = Vo_1^2 + Vo_2^2 + 2Vo_1 \cdot Vo_2\cos(\theta+\alpha) \tag{4}$$

so that these equations are solved under simultaneous equations, being given by $$V = \sqrt{r^2(\omega_1-\omega_2)^2 = (d\omega_2)^2 + 2\,rd\omega_2(\omega_1-\omega_2)\cos\theta} \tag{5}$$

Figure 3:
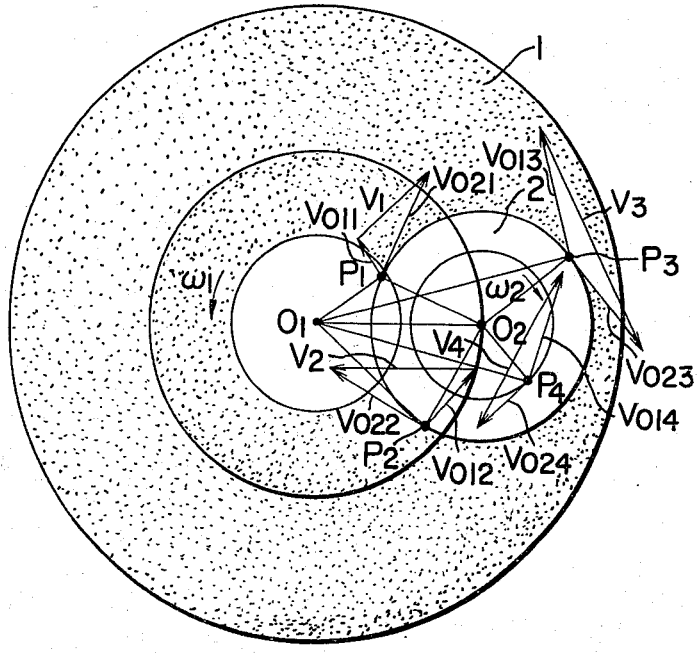
FIG. 3 is a plan view showing velocity vectors at respective points of the work in a forced-drive grain processing machine heretofore used.

The relative velocity vectors $(V_1 - V_4)$ at suitable points $(P_1 - P_4)$ of the piece to be cut in the cutting stroke by a conventional grain processor of the type in which holding means is forced to rotate are shown in FIG. 3 in the form of $\omega_2 = -2\,\omega_1$. As is apparent from the figure, velocity vectors $Vo_{21}$, $Vo_{22}$ and $Vo_{23}$ at respective points $P_1$, $P_2$, and $P_3$ on the circumference on its $O_2$ are equal in their magnitude, while velocity vectors $Vo_{11}$, $Vo_{12}$, and $Vo_{13}$ of motion on its $O_1$ are different, and as a result, the relative velocity vectors $V_1$, $V_2$, and $V_3$ are different from each other in magnitude and direction. It is further obvious that the relative velocity vector $V_4$, in the case where point P is not on the same circumference, but point $p_4$ is located on a different radial circumference, is different in direction and magnitude from the relative velocity vector of the other points $P_1$ to $P_3$. Such a fact is a phenomenon which always occurs in the case of $\omega_1 - \omega_2 \neq 0$, as is clear from the aforesaid equation (5).

Figure 4:
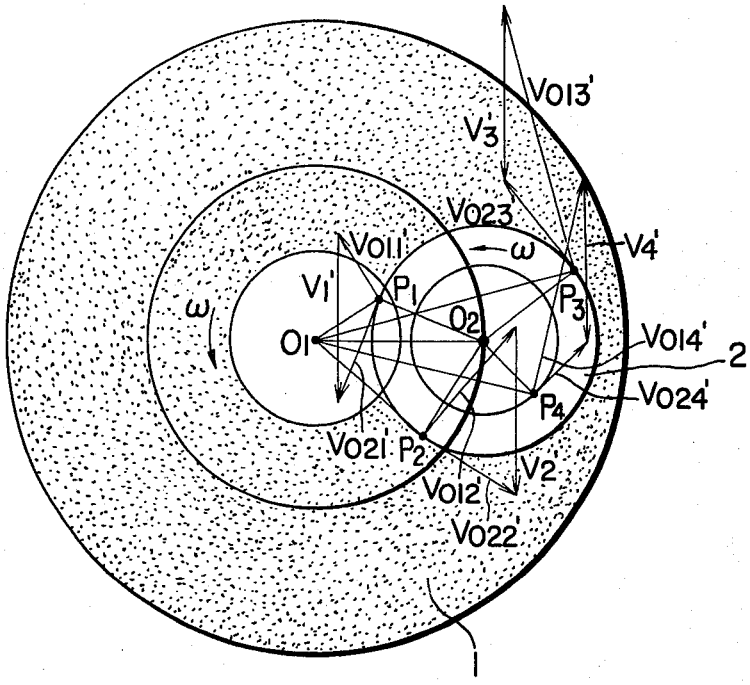
FIG. 4 is a plan view showing velocity vectors at respective points of the work in one mode of embodiment of the grain processing machine according to the present invention.

However, $V = d\omega$ is always obtained when $\omega_1 - \omega_2 = 0$ in Equation (5), that is, $\omega_1 = \omega_2$ $(=\omega)$, so that the magnitude of the relative velocity vector at point P is always constant depending neither on $\gamma$ nor $\theta$, that is, not depending the position of point p. Further, it is apparent that with the increment of difference between both angular velocities, from such a condition that both angular velocities $\omega_1$ and $\omega_2$ are the same, the relative vector at point P is greatly affected by said $\gamma$ and $\theta$. FIG. 4 illustrates the condition of $\omega_1 = \omega_2$ as above described and is drawn corresponding to FIG. 3 to present the relative velocity vectors $V_1' \sim V_4'$ of velocity vectors $V\ o_{11}'$, $Vo_{21}' \sim Vo_{14}'$, and $Vo_{24}'$ caused by both motions at $P_1 \sim P_4$. From FIG. 4 it is made sure that the magnitude and the direction for these relative velocity vectors become exactly the same either in points $P_1$, $P_2$, and $P_3$ existing on the same circumference or in point $P_4$ on a different circumference. Therefore, the slide-and-contact surface of the work with the abrasive wheel has the same relative velocity vector at every point so that the slide-and-contact distance can also always be maintained the same at every point, that is, uniformly.

Such an analysis has not been made in the cutting and polishing operations according to the conventional grain processor. According to the forced driving method as previously described in method (C), wherein the holding means to hold the work in a direction reverse to the rotational direction of the abrasive wheel, the surface to be worked has the magnitude of the relative velocity vector in accordance with the equation (5) and its direction does not coincide either, thus unavoidably resulting in uneven cutting and polishing.

However, the present invention has, as a feature, a construction such that, under the analysis as described above, the rotational direction of the abrasive wheel and the holding means for mounting the work (practically speaking, the work itself) has the same rotational direction which is different from that of the conventional grain processor and, moreover, the angular velocity, that is, the number of revolutions thereof, is the same to effect cutting.

As described above, by the provision of the same number of revolution relative to the work holding means as that of the rotational member, the whole surface of the surface to be cut out of the work contacts the rotational member in a completely uniform manner. In other words, the paths that all of the points on the work make on the rotational member, are exactly the same. However, by the provision of the same number of rotations, the path that a point on the work makes on the rotational member, is a short circular path. This results in that only the specific portion of the rotational member forming said short circular path is used for cutting the work so that one-sided abrasion occurs on the rotational member.

Since the undesirable influence of the non-uniform property of the rotational member to the worked surface can be eliminated by contacting a point of the work with the entire surface of the rotational member, it is desirable that the path which a point on thw work makes on the rotational member is as long as possible.

Figure 6:
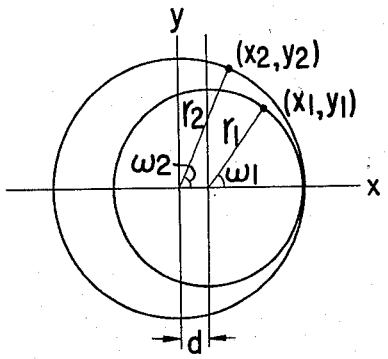
FIGS. 6, 7 and 8 are diagrammatic views showing a locus of slide-and-contact when a certain point of the work is slid into contact with the rotating member.
Figure 7:
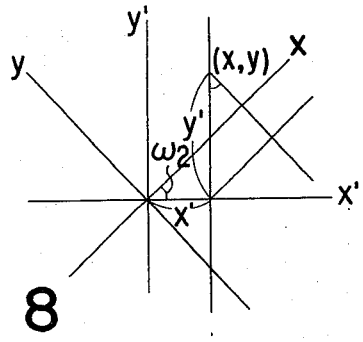

FIGS. 6 and 7 are explanatory views for the purpose of showing a locus of the work to the rotational member due to the variations of the number of revolutions of the work and the number of revolutions of the rotational member. If the rotational member having a radius $r_2$ is rotated on its $O_1$ at an angular velocity $\omega_2$ and the work having a radius of $r_1$ on its $O_1$ at an angular velocity $\omega_1$, as shown in FIG. 6, a locus is depicted by points $(x, y)$ on the radius $r_1$ of the work caused by the rotation of the coordinate axis as shown in FIG. 7, is obviously given by $$\begin{cases} x = r_1 \cos(\omega_1 - \omega_2)t + d \cos \omega_2 t \\ y = r_1 \sin(\omega_1 - \omega_2)t - d \sin \omega_2 t \end{cases} \quad \text{I}$$

Accordingly, when $\omega_1$

Figure 8:
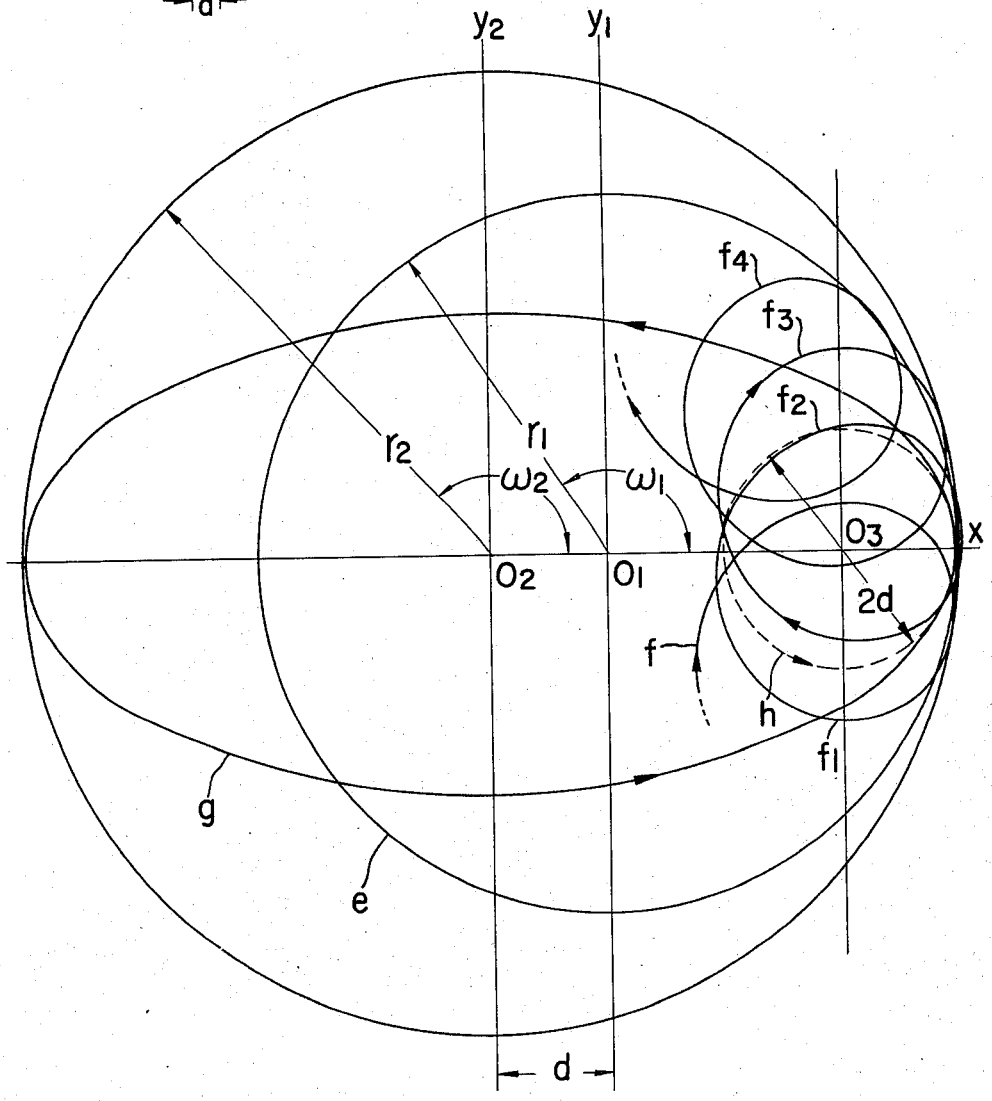

Accordingly when $\omega_1 = \omega_2$, that is, the work and the rotational member are equal in the number of revolutions, the locus depicted by one point $(x, y)$ of the work is given by $$(x - r_1)^2 + y^2 = d^2$$

which is to depict a definite circle $h$ of diameter $2d$ having a center thereof at the distance $r_1$ in the X-direction from the center $0_2$ as shown in FIG. 8. When $\omega_1 = 1.05\omega_2$, that is, the work and the rotational member are different by 5 percent in the number of revolutions, a locus is as shown at $f$ $(f_1F_2, F_3, F_4)$ in FIG. 8 according to equation I, and $f$ comprises 19 pieces of spirals as shown at $F_1f_2f_3f_4$. When $\omega_1$ 32 $2\omega_2$, that is, the work and the rotational member are different by 50 percent in the number of revolutions, an ellipse is depicted as shown at $g$ in FIG. 8.

Because of the difference between the number of revolutions of the rotational member and the number of revolutions of the holding member, the slide-and-contact locus of the work on the rotational member becomes longer.

The provision of an excessive difference in the number of revolutions between them causes too much of difference of the lengths of the paths that the points of the work make on the rotational member, and results in non-uniform cutting of the work, thereby failing to attain uniform cutting of the work, thereby failing to attain the primary object, so that such a great difference may not be provided. It is made sure that according to values experimentally obtained, if the difference between them in the number of revolution is not more than 30% but more than 0%, sufficient cutting accuracy of the work may be maintained. It is of course possible to have a greater difference in the number of revolutions as previously described, at the sacrifice of the cutting accuracy, and the greater the difference as such, the longer the locus path, and the more likely that the one-sided abrasion of the rotational member will be prevented.

PREFERRED EMBODIMENTS OF THE PRESENT INVENTION

Figure 5:
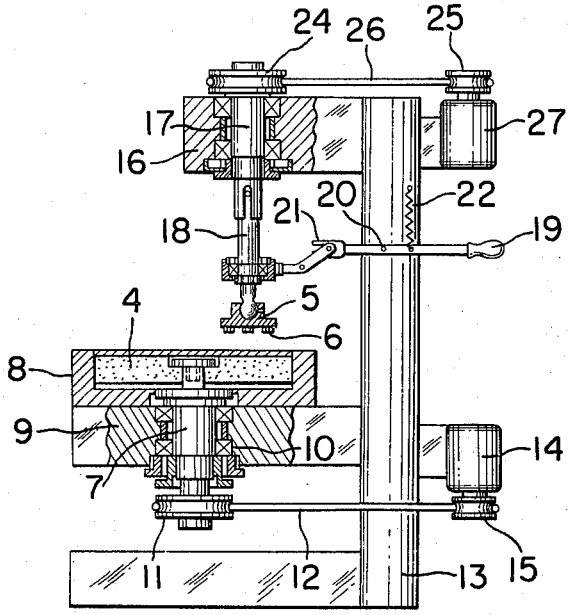
FIG. 5 is a front view (including a view partly sectioned) of one mode of embodiment of the grain processing machine according to the present invention.

Referring to FIG. 5, the driving mechanism, of the main parts in the grain processor by use of the abrasive wheel embodying features of the present invention, will now be described.

The abrasive wheel is shown at 4, which is detachably mounted on a rotatable grinding wheel spindle 7. A cover for the abrasive wheel is designated at 8. Bodies of the abrasive processor, integrally constructed, are designated at 9, 13, and 16, which rotatably support said wheel spindle 7 by means of a ball bearing 10 or the like. The pulley is indicated at 11, which is integrally secured to said wheel spindle 7, and the belt 12 is connected to the other pulley 15 secured to a motor shaft of motor 14 for driving the grinding wheel spindle secured to the body 13 so as to transmit the driving force of said motor 14. It is apparent that power transmission means may also be used other than said pulleys 11, 15 and belt 12. The work holding means 5, to hold the work 6, is attached to the end of a shaft of a movable part 18 in an axial direction of a spindle 17. On said movable part 18 in an axial direction is mounted a lever 19 for vertically moving the spindle, which lever is rotatably secured to the body 13 by means of a pin 20 and provided with an end having a U-shape cut. The movable part 18 is in an axial direction of the spindle to be rotated by operation of said lever, to cause the holding means 5 mounted at its end on the work being held, to enable it to slide and contact with the surface of said abrasive wheel 4. The spindle is rotatably supported through the ball bearing or the like on the body 16, and is rotated and driven by a belt 26 connected between the pulley 24 mounted on the spindle and the pulley 25 secured to the spindle driving motor 27, secured to the body 13. Of course, the transmission of the driving force by motor 27 may also be performed by other transmission means in place of such a pulley.

With the foregoing construction, the work 6 being brought into slide-and-contact with said abrasive wheel 4, both motors 14 and 27 or reduction gears connected thereto are controlled so as to have the same rotational direction and to have almost the same speed of revolution, whereby the cutting and the polishing is effected uniformly on every point of the surface to be worked at almost the same speed.

It will be apparent that free grain can also be used as a lap disc in replace of the abrasive wheel in a lapping machine using the same principles as that described above, and if the rotational velocity of the abrasive wheel and the work is increased and the feed motion is applied to the abrasive wheel or the holding means so as to vary the distance *d* between the axes of said abrasive wheel and the work holding means, a surface grinder having the same idea as that described above can be formed.

In the foregoing embodiment, the work is cut while maintaining such conditions that the relative position between the rotational shaft of the work holding means and the rotational shaft of the rotational member is fixed. It will also be apparent that on the basis of the same idea the holding means and the rotational member may be relatively rocked while maintaining almost the same number of revolutions.

Figure 9:
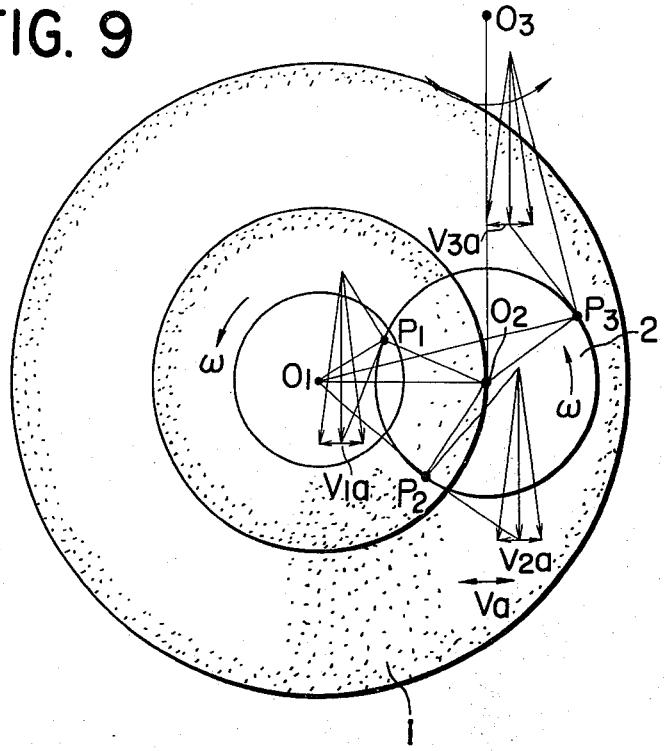
FIG. 9 is a view of velocity vectors at respective points of the work in another mode of embodiment of the grain processing machine according to the present invention.

FIG. 9 shows the condition in the case of further applying a reciprocating motion (rocking) to the work at velocity V*a*, in addition to the motion in the same direction and the same number of revolutions relative to the abrasive wheel shown in FIG. 4. More particularly the center $O_2$ of rotation of the work holding means effects a reciprocating motion at velocity V*a* towards the center $O_1$ of rotation of the abrasive wheel at a suitable period (it may be variable, of course), and said reciprocating or rocking motion is applied to both of said rotational motions so that the relative velocity vector at a suitable point on the surface to be cut of the work is combined with V*a* to enable the relative velocity vector directed in a vertical direction as shown in FIG. 4 to be moved in both directions at a vibration period by the same reciprocating motion as that of V*a* as shown in FIG. 9. Such a relative motion is conceived by a superfinishing machine, and it will be apparent that a similar result may be obtained by application of said reciprocating motion to the abrasive wheel.

The addition of vibrating motion such as reciprocating motion causes relative velocity vectors, such as V1*a*, V2*a*, V3*a*, and V4*a* shown in FIG. 9, at respective points on the surface to be cut of the work to perform a goose-neck motion in the same direction and in the same magnitude simultaneously, so that the relative velocities at respective points of the work at a suitable time after the start of the cutting operation are always the same. The slide-and-contact distance obtained by time-integrating said velocities over the whole slide-and-contact time also becomes the same so that entirely uniform cutting and polishing may be performed. It is apparent that such a vibration is not purely limited to the motion in both left and right hand directions as previously described in FIG. 9. As for example, the holding means may well be vibrated arch-like on its point $O_3$ not on $\overline{O_1O_2}$ shown in the figure and it is easy for the grain processing machine, having such a construction, to give an arch-like vibration as described above. In this case, however, said holding means performs its motion arch-wise on its point $O_3$, and therefore, theoretically V*a* varies in proportion to the distance from point $O_3$, but said variation could not practically be effected except that the size of holding means is not extremely big.

As described above, when the rotational shaft of the work holding means and the rotational shaft of the rotating member are relatively vibrated and if the number of revolutions of the holding means and the rotational members are the same, a locus is made by contact between said rotational member and the work which is limited to the specific locus that produces a one-sided abrasion, but such a disadvantage can be reduced by slightly differentiating number of revolutions of both.

Figure 10A:
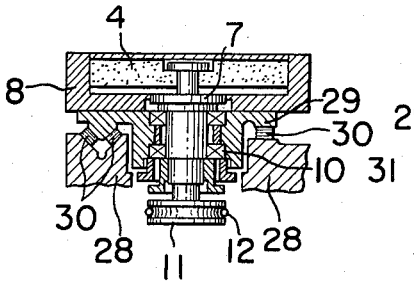
FIG. 10*a* is a front view, partially in section, of another mode of embodiment of the grain processing machine according to the present invention.
Figure 10B:
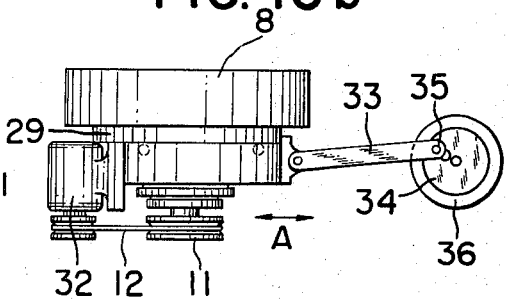
FIG. 10*b* is a side view of the embodiment of FIG. 10*a;*

A mechanism embodying the principle shown in FIG. 9 is shown in FIGS. 10*a* and 10*b* showing main driving parts in the construction with the vibrating motion such as left and right motions added to the abrasive wheel. FIG. 10*a* is a front view in section and FIG. 10*b* is a side view thereof. The same numerical references are used for elements corresponding to those of FIG. 5. That is, the rotation of the abrasive wheel 1 is performed in a manner similar to that as described with reference to FIG. 5. The difference in construction between them will be described. A reciprocating table 29 which carries the wheel cover 8, and reciprocates the same, is slidably mounted through the roller 30 on the body 28 (which corresponds to the body 6 as previously described). On said reciprocating table 29 is mounted one end of the connecting member 33, the other end of which being eccentrically mounted on the rotatable disc 34. Of course, the degree of eccentricity of its mounting 35 from the center of rotation of the disc 34 can be adjusted. This disc is connected to driving means, such as motor 36 and the like, so as to be rotated, and its number of revolutions is variable by the provision of a suitable reduction gear between the disc and the driving means. The rotation of said disc 34 causes the connecting member 33 to be reciprocated, thus enabling the aforesaid reciprocating table 29 to be moved in a direction as indicated by arrow A in FIG. 10*b b*.

The embodiment as shown in the FIGURE is constructed in such a way that the abrasive wheel driving motor 31, as well as said reciprocating table 29, are integrally reciprocated, and a belt 12 is connected between the pulley 32 secured to said motor and the aforesaid pulley to transmit the revolutions of the motor 31 to the abrasive wheel 4. Accordingly, the rotation of the abrasive wheel, as well as the reciprocating motion to and from the work holding means 5, is effected.

Figure 11A:
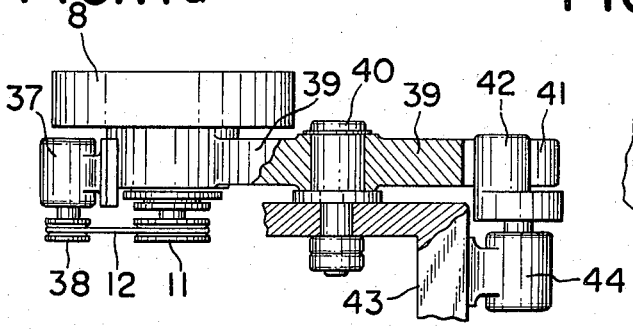
FIG. 11*a* is a side view of a further mode of embodiment of the grain processing machine according to the present invention.
Figure 11B:
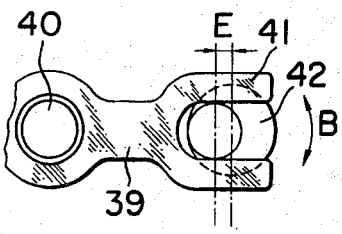
FIG. 11*b* is a plan view of a portion of the embodiment of FIG. 11*a*.

The construction including the rocking motion on the rocking shaft in place of the reciprocating motion, as shown in FIG. 10, as shown in FIGS. 11*a* and 11*b* and FIG. 11*a* is a side view and FIG. 11*b* is a plan view of said rocking part. The same numerical references are used for elements corresponding to those shown in FIG. 5 and FIG. 10. In the construction as shown, the abrasive wheel is rotated and made to be rockable to effect a rocking motion on the axis $O_3$ shown in FIG. 9. The rocking table is shown at 39, which carries the abrasive wheel 8 and is also provided with a motor 37 for driving said abrasive wheel, and the rocking shaft 40 is rockably axially supported by the body 43 (which corresponds to the aforesaid body 9). A fork-like portion 41 is formed at the other end of said rocking table 39, and an eccentric cam of a diameter almost the same as the distance of the recess is engaged in the recess in said fork-like portion. Said eccentric cam 42 is mounted for rocking on the rotational shaft of the motor 44 which is mounted on the body 43. The cam is eccentric by E from the rotational axis of the motor. This eccentricity is of course adjustable.

When the motor 44 is turned on, the eccentric cam rotates with the eccentricity E depicting an orbit of radius E, and the fork-like portion 41 of the rocking table 39 rocks as indicated by the arrow B shown in FIG. 11*b* on the rocking axis 40 so that the other end of the rocking table, viz, the abrasive wheel support part, rocks on the rocking shaft 40. The amplitude of said rocking can be adjusted by varying the amount of eccentricity of the eccentric cam or the distance from the rocking shaft to the respective fork-like portion and the abrasive wheel support part. In this way, the abrasive wheel is furnished with rotation as well as rocking movement.

While the foregoing constructions set forth the invention in its several embodiments of grain processing machines, the said abrasive wheel may be replaced by a lapping disc to form a free grain lapping machine. Also, it is possible to drive the grain cutting tools, such as an abrasive wheel or a lapping disc, and the work holding way by means of one and the same driving means. Further, embodiments have been illustrated, in which either the rotatable grain cutting tool or the work holding means is caused to perform rotational motion as well as reciprocating motion or vibrating motion such as rocking motion, but it is also possible to be constructed in such a way that both of them are rotated in the same rotational direction and in the same number of rotations and at the same time both are reciprocated and vibrated, such as by a rocking motion.

All of these features, functioning in the manner described, result in a grain processing machine which is able to obtain an extremely good finished surface by changing the uneven cutting distance, as seen in the cutting and polishing of the grain processors heretofore used, into the same cutting distance under the new analysis, and which is applicable to a lapping machine, a surface grinding machine, a superfinishing machine, and the like. It is thus possible to improve the yield and quality of the products.

I claim:

1. A grain processing machine comprising supporting means for supporting work to be processed, a first rotation driving motor including a rotating shaft for rotating said supporting means in one direction, a rotating member for grain processing disposed opposite to said work to be processed, a rotating shaft for said rotating member, the rotating shaft of said rotating member being offset from the rotating shaft of said supporting means, a second driving motor for rotating said rotating member in the same direction as said supporting means in a way in which a path that an arbitrary point on said work makes on said rotating member is helical and the difference in the number of rotations between said rotating member and said work to be processed is not more than 30% but more than 0%, and means for shifting said rotating shaft of said rotating member, the rotating shaft of said first rotation driving motor being provided at a fixed position and the rotating shaft of said rotating member for grain processing being pivotable in an arcuate manner, said rotating member for grain processing being secured at one end of a table journaled to a shaft and the other end of said table being eccentrically driven by a rotating means.

2. A grain processing machine according to claim 1, wherein said other end of said table comprises a forked portion to be driven by an eccentric cam, fitted therein having a diameter approximately the same as that of the slot of said forked portion.

3. A grain processing machine according to claim 1, wherein said shaft for said table is fixedly secured to a stationary member, and further comprising means for eccentrically driving said table, said eccentrically driving means being fixedly secured to said stationary member.

4. A grain processing machine according to claim 1, wherein said second driving motor is fixedly secured to said table.

5. A grain processing machine according to claim 1, wherein said shaft for said table is fixedly secured to a stationary member, and further comprising means for eccentrically driving said table, said eccentrically driving means being fixedly secured to said stationary member, and said second driving motor being fixedly secured to said table.

* * * * *

UNITED STATES PATENT AND TRADEMARK OFFICE

CERTIFICATE OF CORRECTION

PATENT NO. : 3,968,598

DATED : July 13, 1976

INVENTOR(S) : HARUO OGAWA

It is certified that error appears in the above-identified patent and that said Letters Patent are hereby corrected as shown below:

First Page, Abstract [57], lines 18 to 24, delete "The rotating member ..... is 30% or less.".

Column 5, line 67, change "thw work" to -- the work --.

Column 6, line 14, in the Equation, delete "Accordingly, when $\omega_1$"; line 28, change "$\omega_1$ 32 $2\omega_2$" to -- $\omega_1 = 2\omega_2$ --; line 38, after "of" (second occurrence), insert -- a --.

Column 7, line 14, after "is", insert -- moved --; line 35, change "replace" to -- place --.

Column 9, line 50, change "way by means" to -- means by way --.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*